US011810747B2

(12) United States Patent
Chilcott et al.

(10) Patent No.: US 11,810,747 B2
(45) Date of Patent: Nov. 7, 2023

(54) WAFER SCALE ENHANCED GAIN ELECTRON BOMBARDED CMOS IMAGER

(71) Applicant: Elbit Systems of America, LLC, Fort Worth, TX (US)

(72) Inventors: Dan W. Chilcott, Buchanan, VA (US); Arlynn W. Smith, Blue Ridge, VA (US); John B. Hammond, Roanoke, VA (US)

(73) Assignee: Elbit Systems of America, LLC, Fort Worth, TX (US)

( * ) Notice: Subject to any disclaimer, the term of this patent is extended or adjusted under 35 U.S.C. 154(b) by 214 days.

(21) Appl. No.: 17/377,065

(22) Filed: Jul. 15, 2021

(65) Prior Publication Data

US 2022/0037106 A1 Feb. 3, 2022

Related U.S. Application Data

(60) Provisional application No. 63/058,256, filed on Jul. 29, 2020.

(51) Int. Cl.
*H01J 31/26* (2006.01)
*H01J 29/04* (2006.01)
*H01J 29/08* (2006.01)

(52) U.S. Cl.
CPC ..... *H01J 31/26* (2013.01); *H01J 29/04* (2013.01); *H01J 29/085* (2013.01)

(58) Field of Classification Search
None
See application file for complete search history.

(56) References Cited

U.S. PATENT DOCUMENTS

| | | | | |
|---|---|---|---|---|
| 4,671,778 | A * | 6/1987 | Musselman | H01J 9/12 445/73 |
| 6,384,519 | B1 * | 5/2002 | Beetz, Jr. | H01J 43/22 313/105 CM |
| 6,657,178 | B2 | 12/2003 | Aebi | |
| 6,836,059 | B2 | 12/2004 | Smith | |
| 9,969,611 | B1 | 5/2018 | Smith et al. | |
| 10,163,599 | B1 | 12/2018 | Smith et al. | |
| 10,734,184 | B1 | 8/2020 | Smith et al. | |
| 2005/0258212 | A1 | 11/2005 | Costello | |

OTHER PUBLICATIONS

International Search Report and Written Opinion issued to PCY/US2021/042153 dated Nov. 15, 2022, 7 pages.

* cited by examiner

*Primary Examiner* — Ashok Patel
(74) *Attorney, Agent, or Firm* — K&L Gates LLP

(57) ABSTRACT

An apparatus, system and method is provided for producing stacked wafers containing an array of image intensifiers that can be evacuated on a wafer scale. The wafer scale fabrication techniques, including bonding, evacuation, and compression sealing concurrently forms a plurality of EBCMOS imager anodes with design elements that enable high voltage operation with optional enhancement of additional gain via TMSE amplification. The TMSE amplification is preferably one or more multiplication semiconductor wafers of an array of EBD die placed between a photocathode within a photocathode wafer and an imager anode that is preferably an EBCMOS imager anode bonded to or integrated within an interconnect die within an interconnect wafer.

15 Claims, 5 Drawing Sheets

WAFER SCALE ENHANCED GAIN ELECTRON BOMBARDED CMOS IMAGER

PRIORITY CLAIM

The present application is based on, claims priority from, and is a continuation of Patent Application Ser. No. 63/058,256, filed Jul. 29, 2020, the disclosure of which is incorporated herein by reference in its entirety.

FIELD OF THE DISCLOSURE

The present disclosure generally relates to image intensifiers used to detect low light level images, and more specifically to an electron bombarded complementary metal oxide semiconductor (EBCMOS) imager that can include further electron amplification or gain, all of which can be manufactured within multiple other image intensifier components on a wafer scale.

BACKGROUND

Low light surveillance cameras such as night vision cameras continue to advance the video display and processing capabilities of image intensifiers. Night vision cameras can include an image intensifier tube, generally known as an image intensifier. An image intensifier includes a vacuum tube into which a photocathode is spaced from a sensor anode. The photocathode detects infrared light in the form of photons from an object or image, and the image intensifier amplifies or multiples the resulting photoelectrons, or electrons, emitted from the photocathode. The anode can include a sensor that, upon receiving the electrons, produces an intensified representation of the image on a screen or display. The photocathode and the anode are typically spaced a parallel distance from each other and are supported within a vacuum housing to provide gain and facilitate the flow of electrons therebetween.

Image intensifiers generate high quality images over a wide range of light levels, including extremely low light levels encountered under starlight and lower illumination levels. The image intensifier is typically small and operates at lower electrical power, thereby making the image intensifier suitable for portable hand-held or head-mounted applications. A need exist for concurrent or simultaneous formation of multiple image intensifiers using wafer fabrication techniques. A need further exists for vacuum sealing the multiple image intensifiers at the same time to achieve consistent, readily repeatable and reliable production at a low cost. That need includes forming each component of the image intensifier on individual wafers, spacing certain wafers apart to maintain an appropriate space or gap, and then heating and evacuating the space to form multiple co-planar intensifiers on a stacked wafer scale before dicing the stacked wafers into stacked and sealed individual image intensifier die. Such need has not been conceived, or met, using conventional production techniques when forming conventional image intensifiers.

SUMMARY

Many image intensifier cameras or, simply, image intensifiers, amplify ambient light into a useful displayed image using the photocathode. The photocathode receives the image, converts photons to electrons, and the electrons are then drawn by electrical bias toward the anode. The bias, or biasing voltage supply, is coupled between the photocathode and the anode to draw the electrons from the photocathode toward the anode. The anode can include a sensor to produce an image when the electrons strike the pixelated surface of the sensor. Thus, the anode is generally referred to as an imager anode. The photocathode and imager anode are separated by a spacer that surrounds a vacuum gap formed between the photocathode and imager anode. The imager anode can provide electron gain as the electrons are applied to the surface of the imager anode.

The imager anode preferably includes a complementary metal oxide semiconductor (CMOS) or charge-coupled device (CCD) imager sensor. The imager sensor consists of a pixelated plurality of CMOS or CCD sensors arranged in an array on an imager anode die region of an imager anode wafer. In addition to the CMOS or CCD sensors, the imager anode die can also include a primary electron multiplier. The primary electron multiplier is preferably an electron bombarded device (EBD) with one gain stage, generally known as a primary electron multiplier stage. The EBD on the imager anode imputes gain to the electrons that strike the imager anode. The multiplied electrons of the primary electron multiplier stay within the substrate of the corresponding input regions of the CMOS or CCD array of sensors.

If desired, another gain stage can be placed between the imager anode and the photocathode. This gain stage, or secondary electron multiplier stage, further increases the electron gain from the photocathode before striking the imager anode. The secondary electron multiplier is a transmission mode secondary electron (TMSE) multiplier. The TMSE is preferably spaced between the photocathode and the imager anode, all of which are contained in the vacuum housing.

The secondary electron multiplier increases the number of electrons for each electron emitted from the photocathode. One form of secondary electron multiplier is a microchannel plate, or MCP. Another form of electron multiplier can be an EBD. Similar to the photocathode and the imager anode, the EBD is manufactured as a die within a corresponding semiconductor wafer using semiconductor fabrication techniques. The EBD-type TMSE is placed between the photocathode and the CMOS or CCD image sensor of the imager anode to increase the electron gain before reaching the imager anode. The image intensifier can be formed with or without a TMSE depending on the amount of gain needed. When the electrons strike the surface of the EBD-type TMSE, the electrons are multiplied while being biased toward the imager anode. The image intensifier with an additional TMSE gain layer can therefore have two EBDs: one for the primary electron multiplier within the imager anode and another for the secondary electron multiplier within the TMSE.

An EBD is a special type of electron multiplier that utilizes advances in semiconductor manufacturing to produce doped regions in a silicon substrate to both multiply and electrically direct the electrons arriving from the photocathode. Because the EBD is produced on a semiconductor wafer, like other components of the image intensifier the EBD is a preferred electron multiplier over MCP electron multipliers. Importantly, the EBD in the secondary electron multiplier is an EBD similar to that of the primary electron multiplier so that the electron emission regions of each semiconductor wafer die of the EBD-type TMSE are aligned with corresponding electron input regions of each semiconductor wafer die of the imager anode. By using proven semiconductor fabrication technology, EBDs can be inexpensively produced in a step and repeat pattern as individual die across a wafer. If two (or more) primary and secondary electron multipliers are needed, the EBD on one wafer can be easily stacked and aligned in array or pixel registration a spaced distance from a similarly formed EBD on another wafer. Of even greater importance, the EBD of the primarily electron multiplier can be formed on the same semiconductor substrate as the CMOS image sensor to form an EBCMOS imager anode die within an EBCMOS imager anode wafer. The entire image intensifier can be formed on stacked die regions of corresponding stacked semiconductor wafers in a reliably produced wafer-scale.

The CMOS image sensor and primary EBD electron multiplier can therefore be integrated together as a EBCMOS die. The EBCMOS die are co-planar to one another as an array of imager anode die across an imager anode wafer. The EBCMOS imager anode die can be bonded to or integrated with die of an interconnect wafer, wherein each interconnect die region of an interconnect wafer includes conductive traces that extend from the imager anode output. The conductive traces can be coupled to a bus further coupled to a digital display for displaying the image sensed by the imager anode. The multiplied electrons traverse the EBD semiconductor structure between an input surface that faces the photocathode and an emission surface that faces the sensor of the imager anode. The EBD of the imager anode is coupled in a vacuum to the biasing voltage supply to draw the electrons from the emission surface of the photocathode or, if a secondary electron multiplier is used, from another EBD within the TMSE.

The image intensifier is preferably formed on a wafer scale, whereby the photocathode is spaced by an insulative spacer, and both the photocathode and the insulative spacer exist as a pair of wafers arranged parallel to each other. A wafer is defined, in the art of semiconductor fabrication, as containing a conventional circumference, diameter and thickness made by slicing individual wafers from a cylinder of material, oftentimes silicon. A wafer contains an array of die, and each die includes dopants and diffusion regions as well as one or more layers of patterned electrically conductive or insulative materials using semiconductor fabrication photolithography. The photocathode wafer and insulative spacer wafer, with an array of openings within the spacer wafer, are aligned over corresponding imager anodes. Imager anodes can be separated as die from an imager anode wafer and then bonded to an interconnect wafer. When the photocathode wafer and the openings of the insulative spacer wafer are aligned over the array of imager anodes bonded to corresponding interconnect die, pump down can occur across the entire wafer stack. Seal then occurs to produce multiple image intensifiers across a vacuum-spaced stack of multiple wafers. After pump down evacuation, getter bake, and die separation from the stacked and spaced wafers, a vacuum gap cavity is maintained between each imager anode of the plurality of imager anodes arranged across die regions of the interconnect wafer and each respective photocathode die of the plurality of photocathodes arranged across the photocathode wafer.

Thus, according to one embodiment, the image intensifier apparatus comprises a photocathode wafer comprising a plurality of photocathodes arranged co-planar to each other in an array across the photocathode wafer. An interconnect wafer is also provided, comprising a plurality of electrically separate sets of conductive traces formed in or upon the interconnect wafer. Similar to the plurality of photocathodes, the plurality of electrically separate sets of conductive traces are in interconnect die regions co-planar to each other in an array across the interconnect wafer. A plurality of imager anodes can be bonded to corresponding electrically separate sets of conductive traces within each interconnect die region. The plurality of imager anodes are arranged co-planar to each other in an array across an imager wafer. An insulative spacer wafer with openings therein can be aligned over the imager anodes, and also aligned between the interconnect wafer and the photocathode wafer. The imager anode consists of a die on the imager wafer that, after separation from the imager wafer, can be bonded to the interconnect wafer. Alternatively, the imager anode die can be integrally formed along with the semiconductor substrate die region that bears the individual set of conductive traces of the interconnect region die. Gaps or cavities can be formed within each space of a plurality of spaces formed between each imager anode of the plurality of imager anodes and each respective ones of the plurality of photocathodes. The gaps or cavities are concurrently or simultaneously evacuated to form a plurality of image intensifiers configured as an array of image intensifier arranged across three or more stacked wafers of substantially equal size: an upper photocathode wafer, a middle insulative spacer wafer, and a lower interconnect wafer, upon which an array of imager anodes are bonded to or integrated within. An imager anode can be separate from or integrated within each interconnect die region of the interconnect wafer. If the former, the imager anodes can therefore be part of each die of the interconnect wafer. If integrated within the interconnect wafer, the conductive traces of an interconnect die region are formed alongside each EBCMOS imager.

According to another embodiment, the image intensifier apparatus can further include a secondary electron multiplier wafer placed between a pair of insulative spacer wafers. The first one of the pair of insulative spacer wafers is placed between the photocathode wafer and the EBD-type TMSE secondary electron multiplier wafer. The second one of the pair of insulative spacer wafers is placed between the secondary electron multiplier wafer and the interconnect wafer. The secondary electron multiplier wafer is preferably an EBD-type TMSE semiconductor gain wafer comprising an array of co-planar EBD die, whereby each EBD die functions to increase the number of free electrons sent to the imager anode. The imager anode is preferably a CMOS imager or sensor that is appropriately biased to draw the free, multiplied electrons from the EBD die. It is noteworthy that the EBCMOS imager of the imager anode comprises a surface that, upon receipt of the free electrons, provides primary electron bombarded gain in and of itself. The EBD-type TMSE layer can provide additional (secondary) electron multiplier gain beyond that afforded by the EBCMOS imager itself.

According to yet another embodiment, an image intensifier apparatus comprises a vacuum gap between the imager anode and the photocathode. The vacuum gap is formed simultaneously with other vacuum gaps between corresponding other co-planar imager anodes bonded to the interconnect wafer and other co-planar photocathodes on the overlying photocathode wafer. If a EBD-type TMSE multiplier wafer is used comprising an array of EBD die, a first vacuum gap can exist between the EBD die of the TMSE multiplier wafer and the photocathode die, and a second vacuum gap can exist between the imager anode die and the EBD die of the TMSE multiplier wafer.

According to yet a further embodiment, a method is provided for forming an image intensifier. The method comprises bonding (or forming) a plurality of imager anodes to (or within) corresponding electrically isolated sets of conductive traces formed across an interconnect wafer.

Thereafter, a plurality of openings are aligned within an insulative spacer wafer over a corresponding plurality of imager anodes. Vacuum sealing can then occur to simultaneously pump down and evacuate a plurality of photocathodes within a photocathode wafer over the corresponding plurality of imager anodes while maintaining the corresponding plurality of openings as cavities or gaps therebetween. The stacked wafers can then be separated by sawing in a direction that is perpendicular to the parallel planes formed by the vacuum sealed and spaced interconnect wafer and photocathode wafer. Scribing also occurs perpendicular to a spacer wafer having spacers between the plurality of openings to produce the image intensifier from among a plurality of concurrently produced image intensifiers.

BRIEF DESCRIPTION OF THE DRAWINGS

Examples of the present disclosure are best understood from the following detailed description when read in connection with the accompanying drawings. According to common practice, the various features of the drawings are not drawn to scale, or are only shown in partial perspective. The dimension of the various embodiments are shown arbitrarily expanded or reduced for clarity. Like numerals are used to represent like elements among the drawings. Included in the drawings are the following features and elements, and reference will now be made to each drawing in which.

DETAILED DESCRIPTION

It should be understood at the outset that, although illustrative implementations of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

From the description provided herein, those skilled in the art are readily able to combine or reverse the connectivity, solder, or brazing operations, or the order by which the wafers are formed and coupled together during the pump down, vacuum bake out, or getter application methodology. While several embodiments have been provided in the present disclosure, it may be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods, without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and may be made without departing from the spirit and scope disclosed herein.

Figure 1:
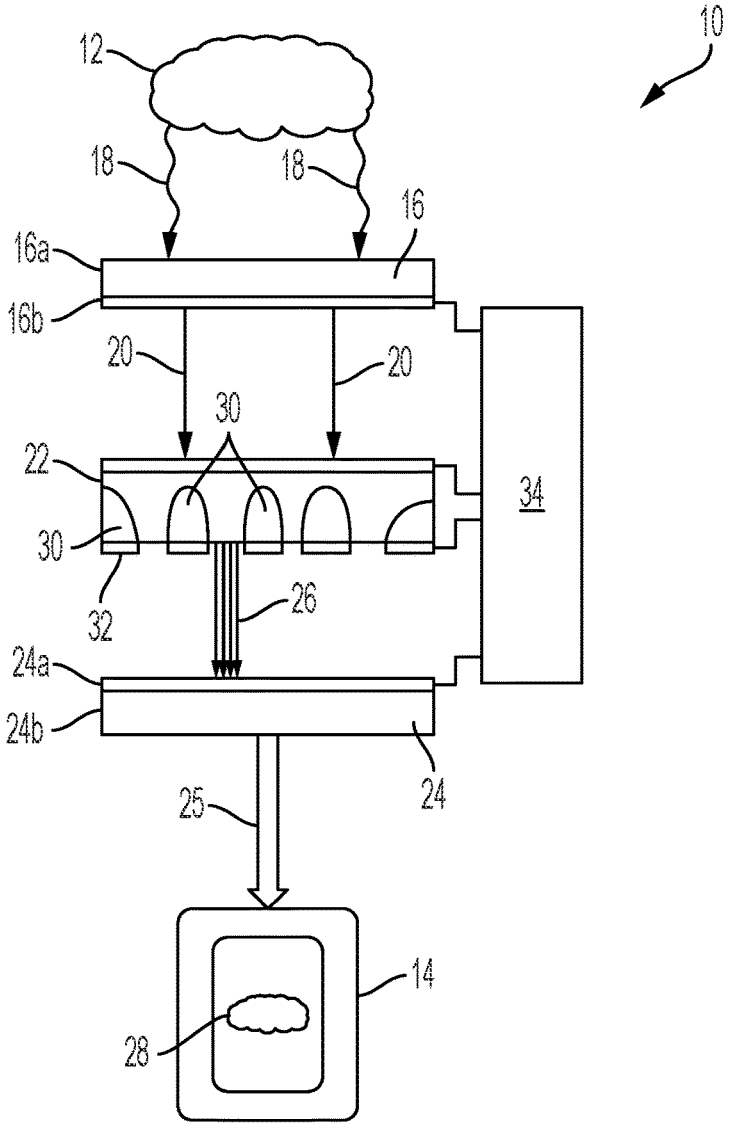
FIG. 1 illustrates an example of an image intensifier comprising an EBD-type transmission mode secondary electron (TMSE) gain layer.

Turning now to the drawings, FIG. 1 illustrates an image intensifier 10 for intensifying a low level image 12 being viewed on a display device 14 as an intensified image 28. Alternatively, image 12 could be configured, not for displaying to a human, but alternatively for machine consumption to automatically actuate the machine based on a collected image in accordance with an exemplary embodiment of the present invention. In a general overview, the illustrated image intensifier 10 includes a photocathode 16 for converting photons 18 of the image 12 into free electrons 20. An EBD 22 is arranged to increase the number of free electrons, and an imager anode 24 with sensor receives the increased number of free electrons 26 and reads out the intensified image signal. That signal can be presented to a display device 14 for human consumption or directly to a controller for use in actuating a machine controlled by the controller without human intervention.

The photocathode 16 can be made from semiconductor materials such as gallium arsenide, or any other materials that exhibit a photo-emissive effect. Other III-V materials can be used such as GaP, GaInAsP, InAsp, InGaAs, etc. The photo-emissive semiconductor material absorbs photons, and the absorbed photons cause the carrier density of the semiconductor material to increase, thereby causing the material to generate a photocurrent of electrons 20 passing through the photocathode 16 for emission from the output surface thereof. Photocathode 16 can be bonded to, for example, an optically transmissive wafer for structural support and environmental protection. The photocathode 16 can include an input surface 16*a* and an output surface 16*b*. When photons impinge the input surface 16*a*, each impinging photon 18 has a probability to create a free electron. Free electrons 20 resulting from impinging photons 18 pass through the photocathode 16 and are emitted from the output surface 16*b*. The output surface 16*b* is activated to a negative electron affinity (NEA) state in a well-known manner to facilitate the flow of electrons 20 from the output surface 16*b* of the photocathode 16. The peripheral surface of the photocathode 16 can be coated with a conducting surface to provide an electrical contact to the photocathode 16.

The EBD 22 multiplies the electrons emitted from the output surface 16*b* of the photocathode 16. EBD 22 includes a semiconductor substrate of doped regions 30, and blocking structures 32. High voltage impacts on the EBD surface create electron gain, and the doped regions 30 in the substrate and substrate surface, as well as the blocking structures 32 on the emission surface direct electrons from the output (or emission surface) surface of EBD 22, between blocking structures 32. The structure and operation of EBDs in image intensifiers for providing secondary electron multiplication of a TMSE by increasing and directing the flow of electrons, and the application of a biasing voltage supply 34 to draw electrons from photocathode 16 and increase or multiply electrons from EBD 22 is commonly known. An EBD-type TMSE is described in U.S. Pat. No. 6,836,059 (herein incorporated by reference).

The imager anode sensor 24 receives the increased number of electrons from the EBD-type TMSE 22 at an input surface 24*a*. The sensor of imager anode 24 is preferably an integrated circuit having a CMOS substrate and a plurality of collection wells commonly used in image intensifier tubes. Multiplied electrons 26 collected in the collection wells are processed using standard signal processing equipment for CMOS sensors to produce an intensified image signal that is sent through an output bus 25 to electronic display 14. In the preferred embodiment, the sensor is a die of a semiconductor wafer containing an array of CMOS integrated circuit pixel sensors arranged across a die of an imager anode 24. The readout of the sensed multiplied electrons 26 are controlled by timing and control circuits, and the signals can be processed by processors of conventional design. The processors can comprise analog-to-digital converters arranged in each column, and the signals are read out by a column select unit and placed on corresponding lines of bus 25. The array of pixels can be a photodiode type pixel structure. When reverse biased, current will flow through the photodiode with incident light creating photocurrent. The photocurrent is sent in corresponding lines of bus 25 to render an intensified image 28 on display 14. The structure and operation of an electron bombarded CMOS imager is described in U.S. Pat. No. 6,657,178, herein incorporated by reference.

Imager anode 24 is biased to draw the multiplied electrons 26 from the output or emission surface of the EBD-type TMSE 22. Within imager anode 24, along with the array of CMOS sensors, is a primary electron multiplier that is preferably an EBD. The primary electron multiplier EBD can be arranged within the input surface 24*a* of imager anode 24, and the CMOS sensor array can be arranged within the output surface 24*b* of imager anode. The primary electron multiplier EBD within the input surface 24*a* is similar to EBD 22 in the secondary electron multiplier, or TMSE, in it provides electron multiplication. However, instead of it providing electron multiplication from photocathode 16 to imager anode 24 as in the EBD-type TMSE 22, the EBD within the input surface 24*a* provides electron multiplication from the input surface 24*a* to the output surface 24*b* of imager anode 24.

Figure 2:
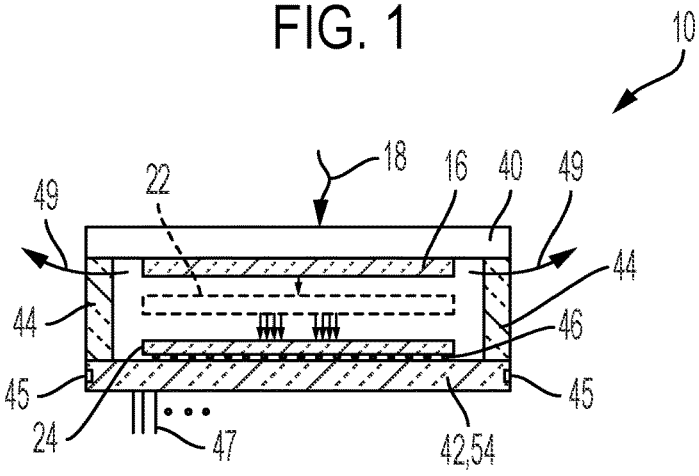
FIG. 2 illustrates an example of an image intensifier formed within a vacuum.

FIG. 2 illustrates an image intensifier 10 within a vacuum created within a housing comprising a sealed upper plate 40, a lower plate 42 and lateral plates 44. Metallic electrical contact pads 46 are aligned and pressed onto trace conductors and are subject to thermal processing or compression bonding. The electrical contact pads 46 can be patterned upon the imager anode 24, which are then bonded upon application of thermal processing or compression to corresponding trace conductors containing bonding pads on the surface of interconnect substrate 54 that can according to one embodiment be the same as the lower plate. The lower plate can therefore be a semiconductor wafer die containing one or more layers of trace conductors on the surface of interconnect substrate and possibly below the surface. The solder material can melt and stick the bonding pads of imager anode 24 to the trace conductors upon and within interconnect die substrate during the soldering process. Although not limited to metallic interconnection processes such as soldering, brazing or thermocompression bonding, seal metal compression bond, it should be appreciated that electrical coupling can occur by other means known to a skilled artisan.

After the imager anode 24 has been run through the electrical interconnection process, it is subjected to a vacuum bake-out as shown by arrow 49 before the housing is sealed around the image intensifier 10. The space between the photocathode 16, or photocathode die 16 and the bonded imager anode 24, or imager anode die 24, can be evacuated below one atmosphere before the lateral plates 44 surrounding all four sides of the imager anode 24 are sealed between the photocathode 16 and imager anode 24. Getter material can be placed on the inward-facing surfaces of spacers 44, for example, and the getter material can be activated during the bake-out process. As the vacuum is created between the photocathode 16 and the imager anode 24, the getter remains to assists in prolonging life of the image intensifier 10 by adsorbing residual gases from all of the components within the vacuum.

To increase gain in the vacuum gap or cavity formed between imager anode 24 and photocathode 16, EBD-type TMSE 22 can be placed in the vacuum gap and an appropriate bias is applied between the photocathode 16 and TMSE 22, as well as between TMSE 22 and imager anode 24. Placement of TMSE 22 is optional depending on the amount of electron multiplication and gain is needed. Given the use of EBD-type TMSE 22 is optional, it is therefore shown in phantom with a dashed line. However, to increase gain in order to overcome limitations of conventional electron bombarded CMOS (EBCMOS) image intensifiers, EBD-type TMSE 22 as a secondary electron multiplier is used. Conventional EBCMOS imager gain is limited by the maximum voltage in the vacuum gap so as not to produce x-rays. Placing EBD 22 therein increases free electrons and gain in the vacuum gap without producing x-rays. Doping in the semiconductor substrate of the EBD 22 helps increase the number of electrons from the input surface into the semiconductor substrate, and through the semiconductor substrate. Inhibiting the recombination of electrons at the input surfaces ensures that more electrons flow through the semiconductor substrate to the emission surface of the EBD-type TMSE 22 as described in commonly assigned U.S. Pat. No. 6,836,059, herein incorporated by reference.

Figure 3:
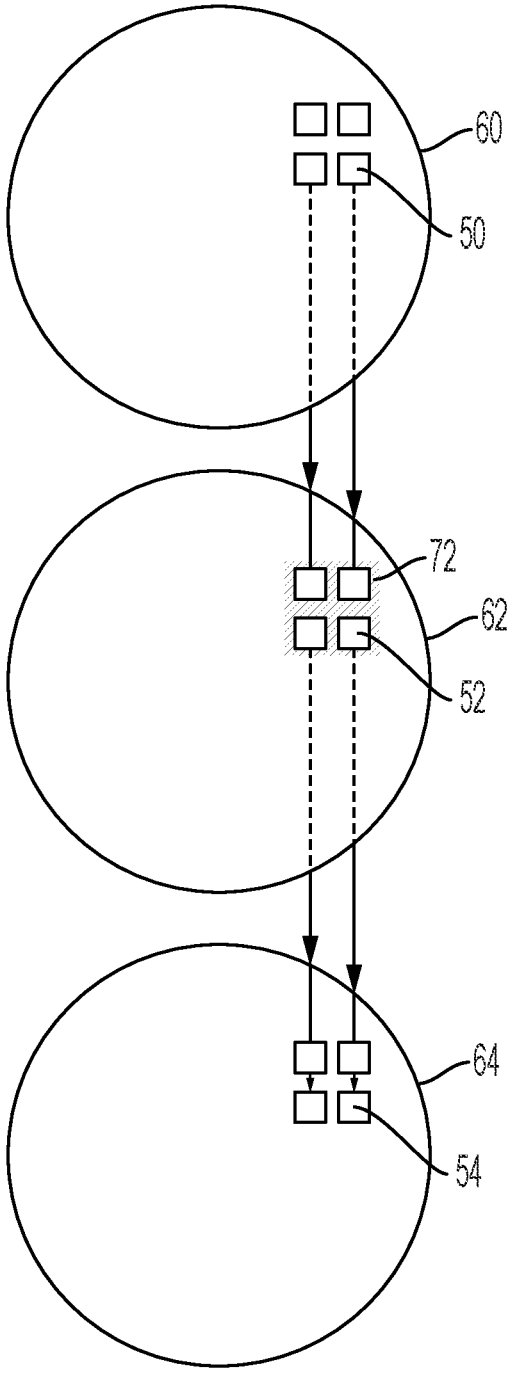
FIG. 3 illustrates an example of an array of photocathodes formed in a photocathode wafer applied over openings formed in an insulative wafer, wherein the photocathode wafer and the insulative wafer are aligned over an array of interconnect die regions of conductive traces on an interconnect wafer.

FIG. 3 illustrates three wafers: photocathode wafer 60, insulative spacer wafer 62, and interconnect wafer 64. Regions 50 within photocathode wafer 60 are die regions and referred to as photocathode dies 16 or simply photocathodes 16. Regions 52 are cutouts or openings within spacer die regions 72 within insulative wafer 62. There is one opening 52 within each spacer die 72, and both are repeated across the insulative wafer. The spacer die 72 therefore comprises four sidewall areas surrounding a substantially square opening 52. Each region 54 within interconnect wafer 64 comprises a set of conductive traces formed on a surface of that region 54. According to one embodiment, the set of conductive traces are bonded to an imager anode 24. As shown in FIG. 2, on the backside surface of each imager anode 24 can comprise an array of bond pads 46 containing an electrical interconnection material that, when compressed and/or heated, bonds to corresponding pads of the electrically separate sets of conductive traces upon and within interconnect die region 54 of interconnect wafer 64. Comparing FIG. 2 to FIGS. 4*a*-4*c*, the lateral plates 44 are formed as insulative spacers 74, upper plate 40 can be the photocathode 50, and lower plate 42 can be the interconnect regions 54.

Alternatively, on the front-side surface of each imager anode 24, either within and part of, or bonded to, an interconnect wafer, are wirebonds that exist outside the vacuum cavity and shielded from the high voltage field therein. If the imager anode is bonded to the interconnect wafer, according to one embodiment, the conductive traces within the interconnect wafer can extend to the backside surface of each die within separately diced interconnect die regions 54 of interconnect wafer 64, where pins 47 shown in FIG. 2 are coupled and extend therefrom. Alternatively, one or more of the set of the conductive traces can extend to the peripheral edges of each corresponding interconnect die region 54 and terminate as edge connectors 45 of FIG. 2.

Each imager anode 24 taken as a die from an imager anode wafer, is bonded to a corresponding set of conductive traces within region 54 of interconnect wafer 64. The interconnect die regions 54 are shown aligned below openings 52, wherein openings exist between insulative spacer die areas 72 repeated across insulative spacer wafer 62. Regions 54 are coplanar with each other across interconnect wafer 64 a parallel spaced distance below yet aligned with photocathode die coplanar regions 50 of photocathode wafer 60. Openings 52 within insulative spacer wafer 62 are aligned between overlying regions 50 of photocathode wafer 60 and underlying imager anodes 24 bonded within regions of 54 of interconnect wafer 64. The formation of the stacked wafers and the subsequent vacuum, or vacuum combined with bake out, provide a wafer scale manufacturing process for concurrently generating an array of co-planar image intensifiers from which a plurality of EBCMOS vacuum image intensifiers are formed once the array is diced and the die are separated from each other.

Figure 4A:
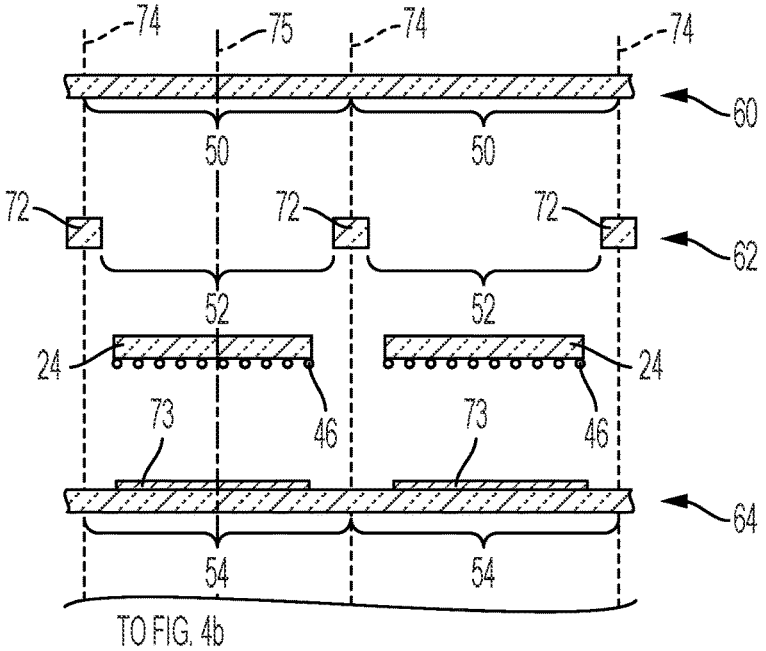
FIGS. 4*a*, 4*b* and 4*c* illustrate an example of a method for aligning the openings in individual die of the insulative wafer to expose corresponding imager anode die to the overlying photocathode die that is spaced by the insulative wafer from the imager anode when concurrently forming a plurality of image intensifiers evacuated on a wafer scale before separating the image intensifiers into individual image intensifiers.
Figure 4B:
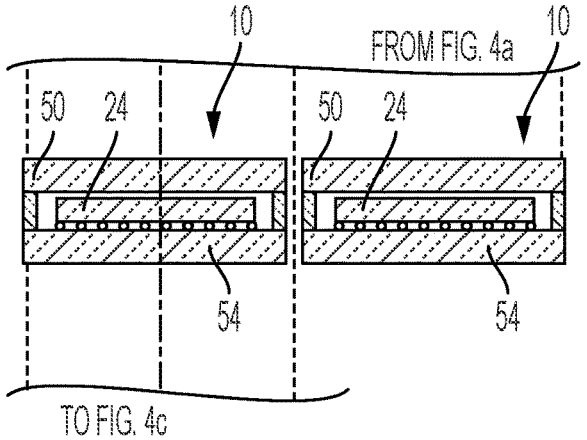

FIGS. 4*a* and 4*b* illustrate cross-sectional views of two image intensifiers 10 formed on a wafer scale. For simplicity in the drawings, only two image intensifiers 10 are shown. Yet, it should be appreciated that up to several hundred image intensifiers 10 are formed at the same time. The process of forming multiple image intensifiers begins by viewing FIG. 4*a*. A photocathode wafer 60 comprises a plurality of photocathodes 50. Only two photocathodes 50 are shown for simplicity corresponding to two image intensifiers 10. Openings 52 between insulative spacers 72 that are within insulative spacer wafer 62 are aligned below corresponding photocathodes 50. Openings 52 are also aligned above interconnect die regions 54 within interconnect wafer 64. Each of the two illustrated imager anodes 24 can be bonded to corresponding each of the two illustrated sets of conductive traces 73 upon and possibly within corresponding regions 54 of interconnect wafer 64. The conductive traces 73 can be formed by applying a layer of metal material across the surface of each interconnect region 54. Through normal photolithography processing, select portions of the metal layer can be removed leaving the electrically separate set of conductive traces 73 in different layers of the region 54 as well as on the outside surface.

The openings 52 within insulative spacer 72 form the high voltage vacuum gaps 70 between the overlying photocathodes 50 and the underlying imager anode 24 bonded to the set of conductive traces upon and within interconnect region die 54. The spacer 72 around each opening 52 is formed when the insulative spacer wafer 62 is cut along the dotted line 74 when dicing and forming the vacuum sealed, stacked set of dies. When the high vacuum envelope is created at the wafer scale, by sealing in a vacuum the entire set of stacked wafers, an array of multiple image intensifiers 10 are formed at the same time. When diced into individual intensifiers 10 at a later time, multiple image intensifiers 10 are formed, as shown in FIG. 4*b*. The spacing of the high voltage vacuum gap is critical, and is concurrently maintained and better controlled across an array of image intensifiers using wafer processing techniques. The geometry and overall planarity of wafers and their processing, ensures through maintenance in polished state, the overall spacing and gap between wafers can be carefully controlled in a low cost, easily accessible precision for the entire wafer stack to produce the resulting separated, stacked and sealed dies.

As noted in FIGS. 4*a* and 4*b*, each die region 50, 52 and 54 of the corresponding wafers 60, 62 and 64 are the same size and dimension. Moreover, a central point of each die region 50, 52 and 54 is aligned with, but no more than a small percentage of pixel size offset (e.g., less than 10 percent), from a central axis 75 that extends perpendicular to the planar surfaces of the stacked dies 50, 52 and 54. The outer lateral sidewall surfaces of each die 50, 52 or 54 are identical in lateral dimension, and when stacked the central point of each die 50, 52 and 54 are also aligned with each other's central point. By making the die the same size and their central points identical in vertical direction on the central axis 75 (through semiconductor wafer 60, 62 and 64 fabrication and subsequent aligned stacking of die 50, 52 and 54), the arrayed or pixelated emission surfaces of the EBD within the arrayed or pixelated input surfaces of the CMOS sensor align directly below and are not offset from electrons emitting the photocathode 16 and also align directly above and are not offset from the corresponding set of conductive traces. Using die fabrication techniques of similarly sized die and precise alignment on the central axis 75 ensures optimal electron gain and current distribution to achieve a more efficient and effective image intensifier 10 concurrently manufactured in mass. Precise X-Y alignment is required if adding an extra EBD-type TMSE layer 22. A high degree of parallelism (from the high precision of thickness control for semiconductor wafers and wafers created for semiconductor processing) between the photocathode die 50 and the imager anode 24 in addition to high precision in controlling the Z axis alignment. There is tight control of distance due to the precision caused by wafer thicknesses and the overall wafer fabrication techniques used in forming the different stacked die components of the image intensifier 10.

Figure 4C:
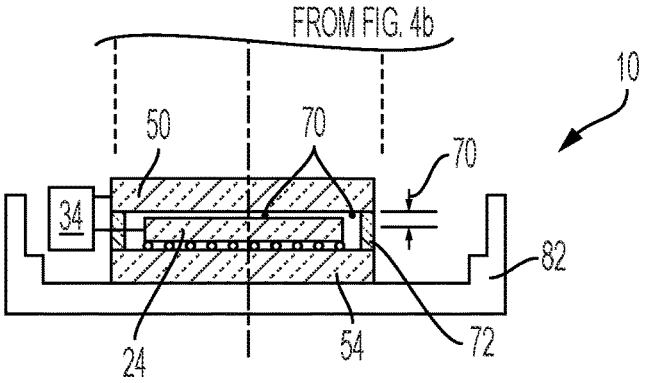

FIG. 4*c* illustrates in cross section the image intensifier 10 bonded to a carrier package 82. The image intensifier 10 is shown assembled with a vacuum gap within a space 70 formed between each imager anode 24 and each photocathode 50. Depending on the amount of gain needed and also whether the sensor in the imager anode 24 is an array of integrated circuits (e.g., CMOS pixelated array sensor), the space 70 can be approximately 10 mils. Moreover, there is a space 70 surrounding the imager anode 24 sidewall and the inward facing surface of the scribed insulated spacer 72 that is divided in half during the die scribe or sawing process. As will be shown in greater detail in FIGS. 5*a* and 5*b*, the bottom or side surfaces of the interconnect region die 54, and specifically the set of conductive traces, can be electrically bonded to carrier package 82. Carrier package 82 can therefore provide additional fan out of the set of conductive traces for electrical connection to display bus 25 of display 14 shown in FIG. 1. Carrier package 82 can also provide additional structure and rigidity to the packaged image intensifier 10, if desired. In some instances, the interconnect die region 54 is sufficient and a carrier package 82 can be eliminated, as shown in FIG. 5*c*. Similar to FIG. 1, the image intensifier 10 shown in FIG. 4*c* includes electrical contacts from electrical supply 34 to photocathode die 50 and to imager anode die 24 to provide sufficient electron gain therebetween.

Figure 5A:
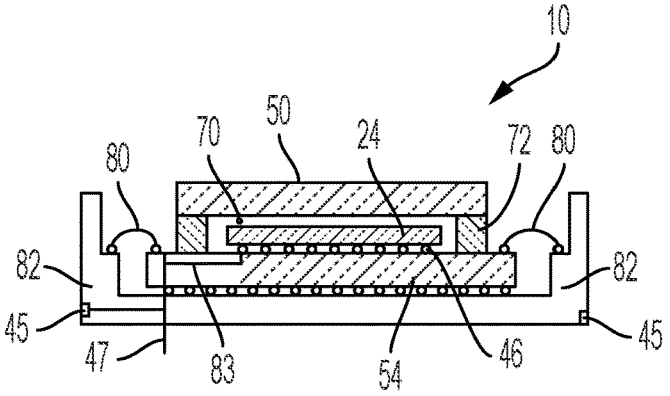
FIGS. 5*a*, 5*b*, 5*c* and 5*d* illustrate, after dicing, an example of the interconnect die extending laterally outside the insulative spacers of the diced insulative wafer, or the imager die bonded to or integrated within the interconnect die that may or may not extend laterally outside the insulative spacers for bonding to a carrier package if present.
Figure 5B:
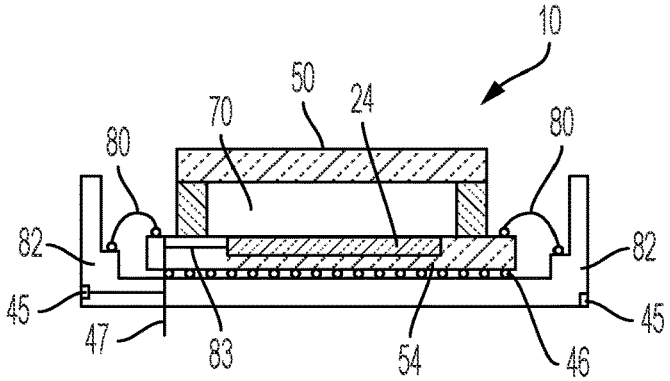
Figure 5C:
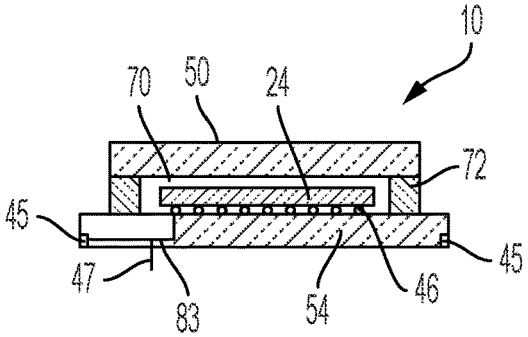

FIGS. 5*a* and 5*b* illustrate cross sectional views of the region 54 of the interconnect wafer 64 for each bonded imager anode 24 being larger than the insulative spacers 72 surrounding openings 52. For clarity purposes, only one trace conductor 83 is shown in the set of trace conductors within interconnect region 54. It is understood that the set of trace conductors can exceed one hundred depending on the density and size of the EBD electron multiplier and CMOS sensor array. The set of trace conductors 83 are shown to extend outside the vacuum package of image intensifier 10 comprising the photocathode insulative spacer 72 bonded between photocathode 50 and interconnect region 54. As shown the trace conductors 83 can extend along an interior planar layer of interconnect region 54. Alternatively, and more preferably, the trace conductors 83 extend along a planar surface of interconnect region 54 toward the exterior lateral surface of the interconnect region 54 outside of the bond pads 46 of imager anode 24 yet electrically coupled to the bond pads 46 shown in FIG. 5*a*. The trace conductors 83 extend from the bond pads 46 to an upper surface of region 54 protruding outside the lateral extents of insulative spacer 74 and coupled to a wire bond 80 that extends connection to a trace conductor (not shown) within carrier package 82. In this fashion, the set of conductive traces 83 within interconnect region 54 extend electrical connection from the bond pads 46 of the imager anode 24 to a wire bonded carrier package 82. In addition to or, alternatively, the set of conductive traces 83 can extend electrical connection from the bond pads 46 to pins 47 and/or edge connectors 45 extending from a bottom and/or side, respectively, of carrier package 82. By forming the interconnect region 54 to accommodate the set of conductive traces beyond the lateral extents of insulative spacer 74, additional fan out connection can be made to the carrier package 82 either as a wire bond 80, a pin 47 routing or an edge 45 routing.

In FIG. 5*b*, bond pads 46 on the imager anode 24 are eliminated. Trace conductors 83 replace the bond pads of FIG. 5*a* and extend from the imager anode 24 to the wire bonds 80, the pins 47 and/or edge connector 45. The trace conductors 83 are preferably connected between outputs of the array of CMOS sensors within the imager anode 24 and the wire bonds 80, pins 47 and/or edge connector 45. The bond pads 46 can, however, be configured on the exterior surface of interconnect region 54 and can electrically couple to conductors (not shown) on or within carrier package 82, if desired to provide additional connectivity and fan out. connection 47 routing The portion of region 54 containing trace conductors that extend outside the vacuum package can accommodate a wire bond 80, for example, to connect the imager anode 24, via bonding pads, to the trace conductors and then outside the trace conductors to the carrier package 82.

In FIG. 5*c*, the carrier package 82 can be eliminated altogether. If the interconnect region 54 is of sufficient structural rigidity and the set of conductive traces 83 within region 54 provide sufficient fan out and density, all connections from the imager anode 24 can easily and reliably occur. The set of conductive traces 83 are shown electrically connecting between bond pads 46 on the imager anode 24 to either pins 47 or edge connectors 45 on the interconnect region die 54 instead of the carrier package 82 of FIGS. 5*a* and 5*b*.

Figure 5D:
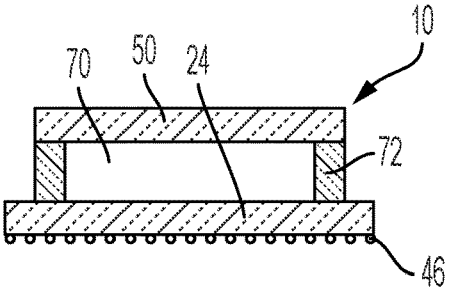

Alternatively, as shown in FIG. 5*d*, the imager anode 24 can extend outside the vacuum package, and specifically outside the lateral extents of insulative spacer 72. The vacuum housing therefore comprises the overlying photocathode 50, opposing lateral spacers 72 aligned with the photocathode 50 yet inside the outer extents of the imager anode 24. A wirebond 80 can couple between a bonding pad on the upper surface of the imager anode 24 and a bonding pad on the carrier package 82 (not shown in FIG. 5*d*). Alternatively the carrier package 82 can be eliminated altogether, similar to FIG. 5*c*. The imager anode 24 is an EBCMOS detector or sensor. A vacuum gap or cavity 70 exists between the frontside surface of the imager anode 24 and the photocathode 50. An array of bond pads or bumps 46 on the backside surface of the imager anode 24 can be electrically interconnected to corresponding set of conductive traces on the surface of interconnect die region 54. As noted, the imager anode 24 can be a part of the interconnect die region 54 (shown in FIG. 5*b*) with the set of conductive traces of the interconnect printed into the interconnect die region along with the CMOS sensor array. If the interconnect die region 54 includes both the imager anode 24 and the set of conductive traces 83, the backside surface or a part of the frontside surface can be bonded to a circuit board using bonding pad and/or wire bond compression or heating.

Figure 6A:
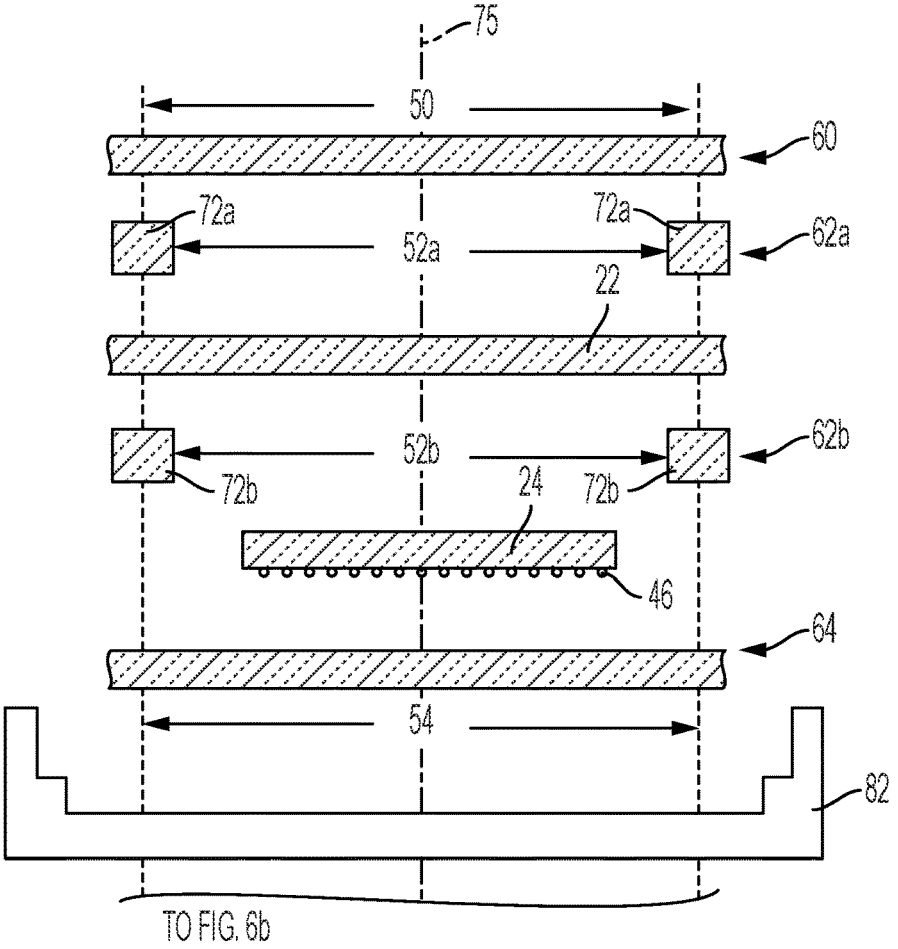
FIGS. 6*a* and 6*b* illustrate an example of a secondary electron multiplier TMSE gain wafer added between a pair of insulative wafers after sealing and evacuation to produce two vacuum gaps or cavities while concurrently forming a plurality of image intensifiers of enhanced gain.
Figure 6B:
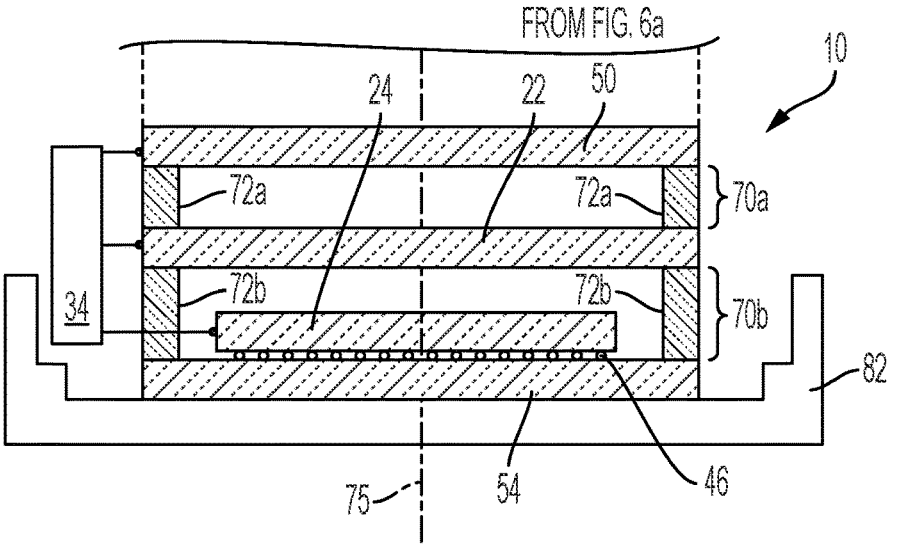

FIGS. 6*a* and 6*b* illustrates cross sectional views of an image intensifier 10 formed concurrently among a plurality of image intensifiers. More specifically, FIG. 6 illustrates an image intensifier 10 having additional gain via a secondary electron multiplier 22. An electrical bias supply 34 provides electron gain and bias from photocathode die 50, EBD-type TMSE die 22 and imager anode 24. The secondary electron multiplier 22 is preferably a EBD-type TMSE die 22 that is parallel-spaced between a pair of openings 52*a* and 52*b*. The pair of openings 52*a* and 52*b* exist within a corresponding pair of insulative spacer die regions within respective insulative wafers 62*a* and 62*b*. The insulative spacer die regions comprise corresponding insulative spacers 72*a* and 72*b* surrounding corresponding high voltage vacuum gaps 70*a* and 70*b* formed by respective openings 52*a* and 52*b*. The backside of the interconnect die region 54 of the interconnect wafer 64 can bond to the carrier package 82. Alternatively a wire bond (not shown) can interconnect the conductive traces within region 54 when region 54 extends beyond imager anode 24 and the outer extents of the insulative spacers 72*a* and 72*b*. The ball grid array or thermal compression bond array 46 electrically connects the imager anode 24 (preferably including a primary electron multiplier and a CMOS sensor or detector array detector) to the interconnect region 54 of the interconnect wafer 64. Alternatively, to further increase the gain, more than one EBD-type TMSE layer 22 can be inserted between corresponding pairs of spacer layers 62, all of which exist between the photocathode 50 and the imager anode 24 embedded within or bonded upon interconnect die region 54.

The photocathode 50 die central point, the EBD-type TMSE 22 die central point, the imager anode 24 die central point, and the interconnect region 54 die central point are each aligned on the central axis 74. Moreover, the central axis 74 is shown as the central axis of the formed image intensifier 10. Not only are each die of the same size and dimension, but the central point on the upper and lower planar surfaces of each die align with and are on the central axis 74 to ensure proper operation of the formed image intensifier 10. For example, if there is any offset greater than, for example, 50 percent of the pixel pitch from the central axis, the array of primary and secondary electron multipliers will not align with each other and they will also not align with the CMOS sensor array within the imager anode 24.

As used herein, "about," "approximately" and "substantially" are understood to refer to numbers in a range of numerals, for example the range of −10% to +10% of the referenced number, preferably −5% to +5% of the referenced number, more preferably −1% to +1% of the referenced number, most preferably −0.1% to +0.1% of the referenced number.

Furthermore, all numerical ranges herein should be understood to include all integers, whole or fractions, within the range. Moreover, these numerical ranges should be construed as providing support for a claim directed to any number or subset of numbers in that range. As used herein and in the appended claims, the singular form of a word includes the plural, unless the context clearly dictates otherwise. Thus, the references "a," "an" and "the" are generally inclusive of the plurals of the respective terms.

Without further elaboration, it is believed that one skilled in the art can use the preceding description to utilize the claimed inventions to their fullest extent. The examples and aspects disclosed herein are to be construed as merely illustrative and not a limitation of the scope of the present disclosure in any way. It will be apparent to those having skill in the art that changes may be made to the details of the above-described examples without departing from the underlying principles discussed. In other words, various modifications and improvements of the examples specifically disclosed in the description above are within the scope of the appended claims. For instance, any suitable combination of features of the various examples described is contemplated, including the orientation of the photocathode above, below, or spaced to the right or left of the imager anode. Depending on the orientation of the image intensifier relative to the image being detected, the photocathode relative to the imager anode can change provided the photocathode is between the imager anode and the image.

What is claimed is:

1. An image intensifier apparatus, comprising:

a photocathode wafer comprising a plurality of photocathode regions;

an interconnect wafer comprising a plurality of electrically separate sets of conductive traces formed in or upon the interconnect wafer;

a plurality of imager anodes integrated among or bonded to corresponding electrically separate sets of conductive traces;

an insulative spacer wafer with openings therein aligned over the imager anodes and between the interconnect wafer and the photocathode wafer; and gaps within each space of a plurality of spaces formed between each imager anode of the plurality of imager anodes and each of the respective plurality of photocathodes through which the plurality of spaces are simultaneously evacuated to concurrently form a plurality of image intensifiers thereafter diced to form the image intensifier apparatus.

2. The image intensifier apparatus of claim 1, wherein the photocathode wafer comprises:

gallium arsenide semiconductor materials; and an array of co-planar photocathode regions comprising the gallium arsenide semiconductor materials and corresponding to the plurality of photocathodes.

3. The image intensifier apparatus of claim 1, wherein the interconnect wafer comprises:

a coplanar array of photolithography patterned metal material in or upon a substrate in a corresponding array of co-planar interconnect regions that correspond to the respective electrically separate sets of conductive traces.

4. The image intensifier apparatus of claim 1, wherein the insulative spacer wafer comprises:

photolithography patterned electrically insulative material; and an array of co-planar opening regions corresponding to the openings that extend entirely through the insulative spacer wafer surrounded on all four sides of each of the openings by the insulative material.

5. The image intensifier apparatus of claim 2, wherein the plurality of imager anodes comprise:

an array of co-planar and separate primary electron multipliers facing the corresponding array of co-planar photocathode regions;

an array of complementary metal oxide semiconductor (CMOS) sensors configured to receive multiplied electrons from corresponding primary electron multipliers and produce an electrical signal from each CMOS sensor.

6. The image intensifier apparatus of claim 5, further comprises a digital display coupled to receive the electrical signal from each CMOS sensor.

7. An image intensifier apparatus, comprising:

a photocathode within a portion of a photocathode wafer;

an interconnect comprising a set of conductive traces within a portion of an interconnect wafer;

an imager anode coupled to the set of conductive traces;

an insulative spacer comprising an opening formed in a portion of an insulative spacer wafer; and a vacuum gap between the imager anode and the photocathode among a plurality of simultaneously formed other vacuum gaps between corresponding other co-planar imager anodes and other co-planar photocathodes on the photocathode wafer.

8. The image intensifier apparatus of claim 7, wherein the photocathode comprises:

a glass faceplate formed from a glass wafer bonded to the photocathode wafer;

gallium arsenide or other type III-V materials coated upon or epitaxially grown on a surface of the photocathode wafer facing away from the glass faceplate.

9. The image intensifier apparatus of claim 7, wherein the interconnect comprises:

photolithography printed set of conductive traces on at least one layer of the interconnect wafer.

10. The image intensifier apparatus of claim 7, wherein the imager anode comprises a complementary metal oxide semiconductor (CMOS) sensor arranged in an array of pixels integrated within the same semiconductor body as the interconnect wafer and coupled to the set of conductive traces.

11. The image intensifier apparatus of claim 7, wherein the imager anode comprises:

a complementary metal oxide semiconductor (CMOS) sensor arranged in an array of pixels on a separate semiconductor body than the interconnect wafer; and a set of pads on a surface of the CMOS sensor configured to be electrically bonded to the set of conductive traces.

12. The image intensifier apparatus of claim 7, wherein the imager anode comprises an array of co-planar primary electron multipliers facing the corresponding array of co-planar photocathodes; and an array of complementary metal oxide semiconductor (CMOS) sensors configured to receive multiplied electrons from corresponding primary electron multipliers and to produce an electrical signal.

13. The image intensifier apparatus of claim 12, further comprising:

an array of co-planar secondary electron multipliers arranged within a semiconductor wafer separate from the photocathode wafer and the interconnect wafer, wherein the array of co-planar secondary electron multipliers are further arranged between the corresponding array of co-planar photocathodes and the corresponding array of CMOS sensors;

a first vacuum gap between one of the secondary electron multipliers and the photocathode; and a second vacuum gap between the one of the secondary electron multipliers and the imager anode.

14. The image intensifier apparatus of claim 7, wherein a diameter of the photocathode wafer, the insulative spacer wafer and the interconnect wafer are the same.

15. The image intensifier apparatus of claim 7, wherein the photocathode wafer, the insulative spacer wafer and the interconnect wafer are aligned with respect to each other so that the outer lateral extents of each other are the same and a central point of each die of the photocathode wafer, the insulative spacer wafer and the interconnect wafer are arranged along a central axis that extends perpendicular to the stacked photocathode wafer, the insulative spacer wafer and the interconnect wafer.

* * * * *